United States Patent [19]

Sanford

[11] 4,082,298

[45] Apr. 4, 1978

[54] INFLATABLE PACKER AND VALVE MECHANISM THEREFOR

[76] Inventor: Lawrence Sanford, 4047 Hollister, Houston, Tex. 77055

[21] Appl. No.: 633,404

[22] Filed: Nov. 19, 1975

[51] Int. Cl.[2] ..... F16J 15/46

[52] U.S. Cl. ..... 277/34.3; 277/103; 166/187

[58] Field of Search ..... 277/34, 34.3, 34.6, 277/27, 116.4, 103; 166/187

[56] References Cited

U.S. PATENT DOCUMENTS

| | | | |
|---|---|---|---|
| 2,684,274 | 7/1954 | Saxon | 277/103 |
| 2,994,378 | 8/1961 | Reistle | 166/187 |
| 3,337,222 | 8/1967 | Smith et al. | 277/34.3 |
| 3,397,893 | 8/1968 | Kampert | 277/27 |
| 3,527,296 | 9/1970 | Malone | 277/34 |
| 3,940,151 | 2/1976 | Phillips | 277/103 |
| 3,941,190 | 3/1976 | Conover | 277/34.6 |

*Primary Examiner*—Richard E. Aegerter
*Assistant Examiner*—L. Footland
*Attorney, Agent, or Firm*—Browning, Bushman & Zamecki

[57] ABSTRACT

An inflatable packer including a tubular mandrel having generally radial ports therethrough and a sub slidably telescopically mounted on the mandrel. A first annular space, in communication with the ports, is formed between the mandrel and the sub. An inflatable packer element is carried by the sub, the mandrel extending through the packer element such that a second annular space is formed between the mandrel and the packer element. A valve mechanism is disposed in the first annular space and includes an annular seal means and a locking mechanism. The seal means is operative upon the presence of pressure differential decreasing thereacross toward the second space to permit fluid flow through the first annular space from the ports to the second annular space and inflate the packer element. The seal means is further operative upon the presence of pressure differential decreasing thereacross toward the ports to form a seal between the ports and the second annular space. The locking mechanism is operatively associated with the seal means to lock the mandrel against upward movement with respect to the sub upon the presence of the last mentioned pressure differential. An upward pull on the mandrel releases the locking mechanism to break the seal and deflate the packer element.

14 Claims, 8 Drawing Figures

FIG. 3
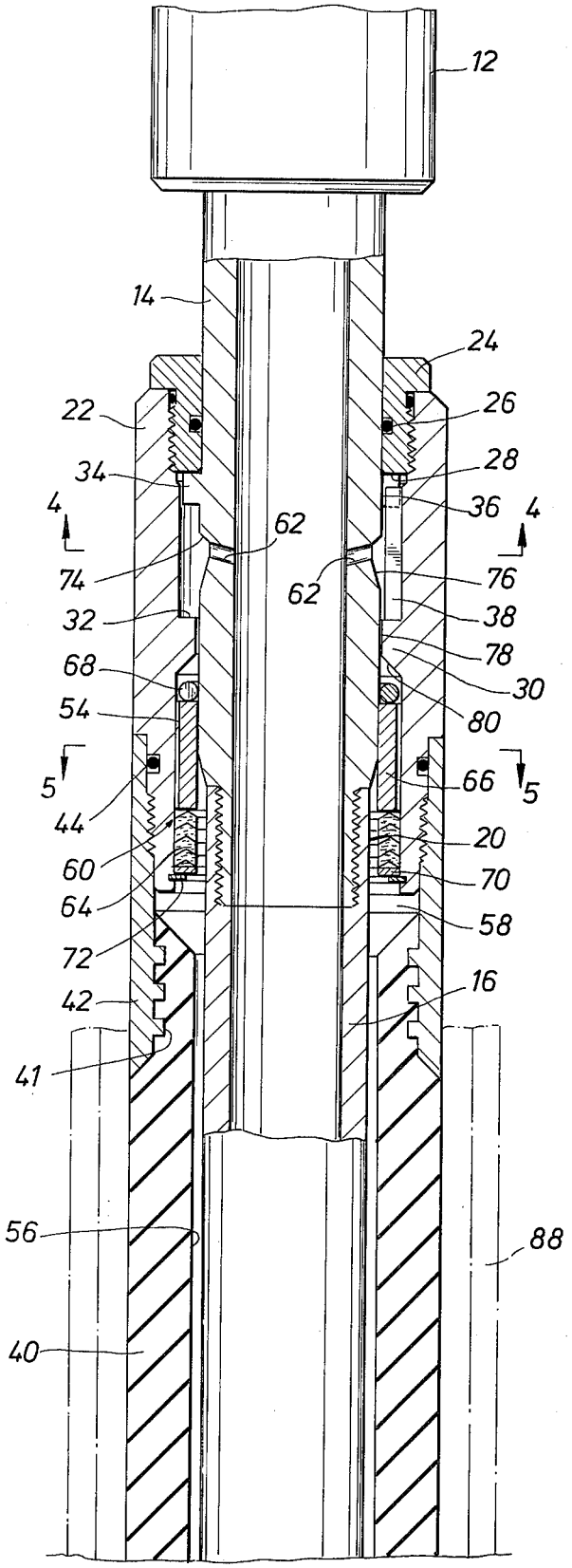
FIG. 4
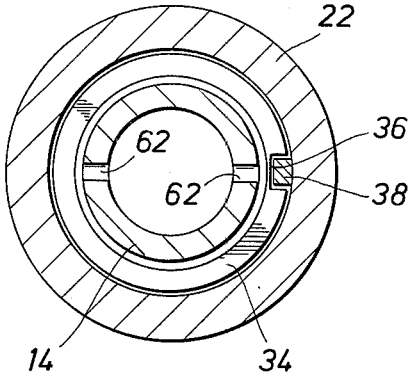
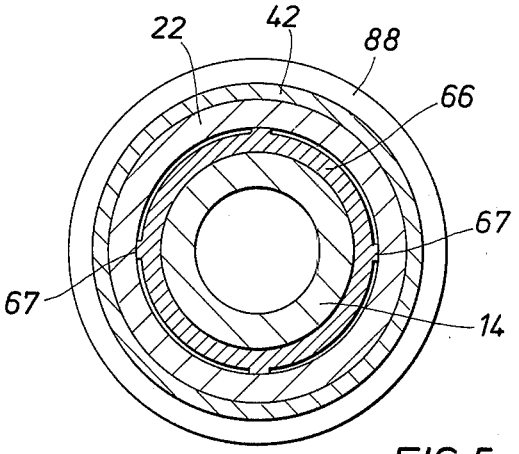
FIG. 5
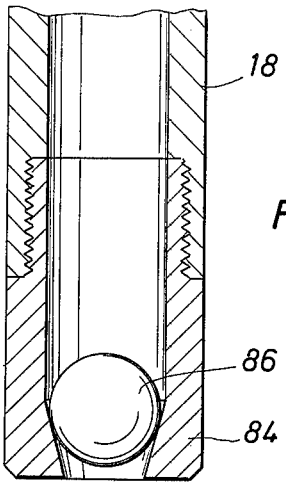
FIG. 6

INFLATABLE PACKER AND VALVE MECHANISM THEREFOR

BACKGROUND OF THE INVENTION

1. Field of the Invention

The present invention pertains to packers of the type used to seal the interior of a well, either cased or uncased, with respect to the exterior of a string of drill stem, tubing or the like. In particular, the invention pertains to packers of the inflatable type in which a packer element, carried by a suitable tool, is placed in the well at the proper depth and then inflated with fluid pressure to seal against the inner surface of the well bore, casing or the like. Such packers find numerous uses in the drilling, production, and/or servicing of wells for the recovery of petroleum, natural gas, water, etc. For example, in connection with oil wells, such inflatable packers may be used to seal off an oil/water interface, to isolate a lost circulation zone of the well, to isolate various zones of the well for testing purposes, etc.

2. Description of the Prior Art

In inflatable packers, a valve or other mechanism is needed to control inflation and setting of the packer element after it has been properly positioned in the well. That mechanism or another one must then operate to deflate the packer element, unless it is to remain permanently set.

One such type of valve commonly employed makes use of shear pins to hold a valve member in a normally open or closed position. Fluid pressure build-up acting on the valve element causes the pins to shear so that the valve element will move to the desired position. Examples of such valves may be found in U.S. Pat. Nos. 3,053,322 to Kline, 3,503,334 to Cockrum et al., and 3,160,211 to Malone. The use of shear pins has several disadvantages. For one, the pins may be accidentally broken allowing premature operation of the valve. Secondly, once the shear pins have been broken, the valve element cannot be easily reset down hole. Thus, there is necessarily a limit to the number of times the packer can be deflated and reset.

In other packers, such as those shown in U.S. Pat. Nos. 3,085,628 to Malone and 3,552,486 to Burns, valves are opened and/or closed by rotation of either the drill string or of a separate tool from the top of the well. Such devices are expensive and complicated to use. Furthermore, they are subject to jamming and other malfunctions.

Still other inflatable packers, such as that in U.S. Pat. No. 2,994,378 to Reistle, Jr., are operated by non-rotary tools from the top of the well. Again, the procedure is expensive and bothersome.

SUMMARY OF THE PRESENT INVENTION

The present invention comprises an inflatable packer having a valve mechanism which is operated solely by application of fluid pressure and by longitudinally acting force on the drill stem, tubing, or the like. The invention eliminates the need for shear pins, application of rotational forces, and use of separate force transmitting tools extending from the top of the well to the packer. Additionally, the packer element can be deflated and reset downhole as many times as desired easily and quickly.

The packer of the invention comprises a tubular mandrel having generally radial ports therein. A sub is slidably telescopically mounted on the mandrel so that a first annular space is formed between the mandrel and the sub and in communication with the port means. The sub carries an inflatable packer element, and the mandrel extends through the packer element to form a second annular space between the packer element and the mandrel.

The valve mechanism is disposed in the first annular space and includes an annular seal means and a locking mechanism. The seal means is operative upon the presence of a pressure differential decreasing thereacross toward the second space to permit fluid flow through the first space from the ports to the second space and thereby inflate the packer element. The seal means is further operative upon the presence of a pressure differential decreasing thereacross toward the ports to form a seal between the ports and the second space.

The locking mechanism is operatively associated with the seal means so that, upon presence of the pressure differential decreasing toward the ports, the locking mechanism locks the mandrel against upward movement with respect to the sub. However, the locking mechanism is releaseable upon the application of a sufficient upward force to the mandrel to permit upward movement of the mandrel. Such movement breaks the seal by bringing a reduced diameter section of the mandrel into alignment with the seal means, thereby deflating the packer element.

Thus to inflate the packer element, fluid is pumped through the mandrel and its ports, through the first annular space past the seal means, and into the second space between the mandrel and the packer element. When sufficient fluid has been pumped into the packer element, the pressure is released. Fluid now tends to flow from the second space toward the ports resulting in the formation of a seal so that fluid cannot flow through the first annular space toward the ports. At the same time, the seal means oprates the locking mechanism so that the mandrel cannot move upwardly to break the seal unless a sufficient force is exerted on the mandrel from the top of the well.

When the force is exerted on the mandrel to break the seal, the packer can be reset by reinflating it, returning the mandrel to the position in which the reduced diameter section is not aligned with the seal means, and again releasing the fluid pressure internally of the mandrel. The packer can be released and reset as many times as desired in this manner.

It is thus a principal object of the invention to provide an improved mechanism for inflating and deflating a packer element.

Still another object of the present invention is to provide an inflatable packer which can be reset downhole an unlimited number of times.

Yet a further object of the present invention is to provide an improved inflatable packer which can be operated without the use of shear pins, without rotation of any part of the packer or any other tool, and without the use of a separate force transmitting tool.

Other objects, features, and advantages of the invention will be made apparent by the following description of a preferred embodiment, the drawings, and the claims.

BRIEF DESCRIPTION OF THE DRAWINGS

FIG. 3 is a longitudinal sectional view through the upper portion of the packer prior to inflation or after release of the packer element.

FIG. 4 is a transverse sectional view on lines 4—4 of FIG. 3.

FIG. 5 is a transverse sectional view on lines 5—5 of FIG. 3.

FIG. 6 is a fragmentary view of an alternative closure means for the lower end of the mandrel.

DESCRIPTION OF THE PREFERRED EMBODIMENTS

Figure 1A:
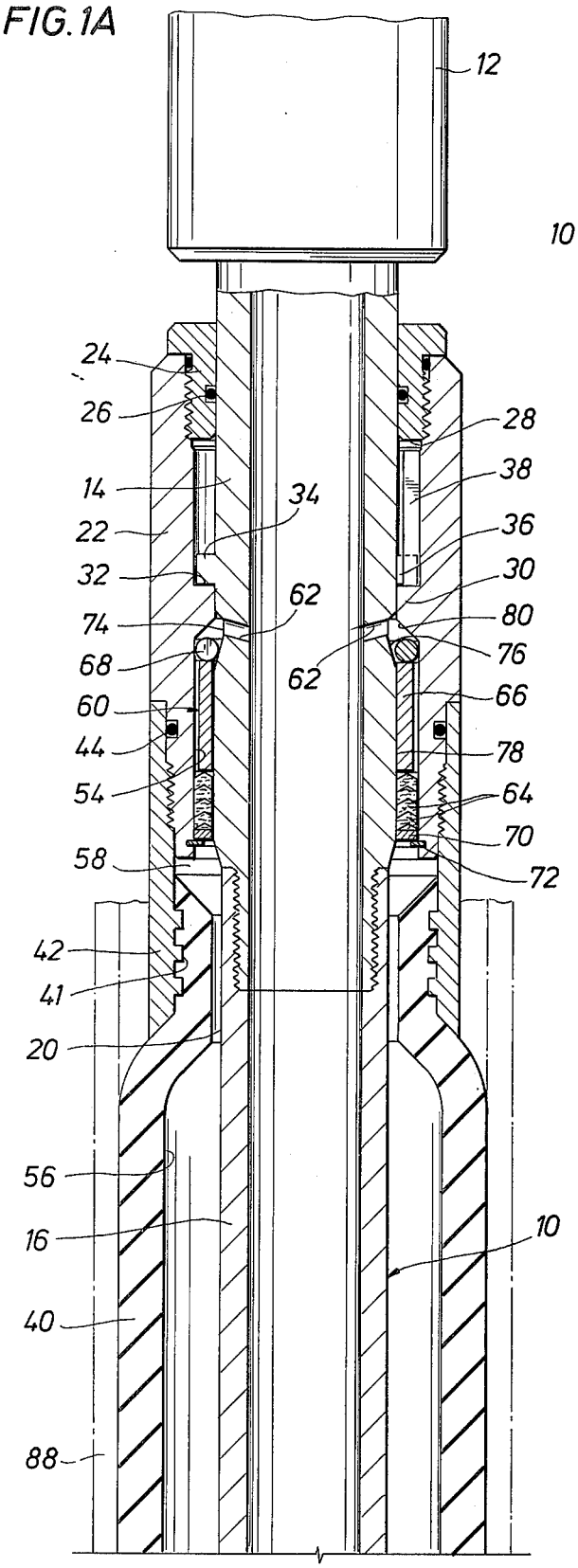
FIG. 1A is a longitudinal sectional view through the upper portion of a packer according to the present invention after inflation but prior to setting of the packer element.

Referring to the drawings the packer comprises a tubular mandrel 10 the upper end of which is joined by a suitable connector 12 to a string of drill stem, tubing, or the like (not shown) extending from the mandrel to the top of the well. The mandrel 10 comprises three tubular components: an upper control tube 14, a central packer tube 16, and a lower extension tube 18, threadedly connected in end-to-end relation. The outer diameter of the packer tube 16 is smaller than those of the control tube 14 and extension tube 18 so that it forms a reduced outer diameter section 20 of the mandrel 10.

The packer further comprises a control sub 22 slidably, telescopically mounted on the control tube 14. A gland nut 24 is threaded into the upper end of control sub 22. The gland nut 24 provides a close sliding fit against the exterior of the control tube 14 and carries an O-ring 26 which seals against the control tube 14. The lower end of gland nut 24 forms a downwardly facing shoulder 28 between control sub 22 and control tube 14. An internal annular ridge 30 on the control sub 22 forms an upwardly facing shoulder 32 opposed to and axially spaced from shoulder 28. Control tube 14 has an external annular flange 34 disposed between shoulders 28 and 32 and cooperative with shoulders 28 and 32 to limit relative longitudinal movement between the control sub 22 and the mandrel 10. As best seen in FIG. 4, flange 34 has a radially outwardly directed slot or keyway 36 for receipt of an elongate radial inwardly directed key 38 on the control sub 22 whereby relative rotation of the mandrel 10 and control sub 22 is prevented.

An inflatable tubular packer element 40 is carried by the lower end of the control sub 22 via a tubular upper packer head 42 whose upper end is threadedly connected to the lower end of the control sub 22 and whose lower end is attached to the upper end of the packer element 40. An O-ring 44 forms a seal between control sub 22 and upper packer head 42. Mandrel 10 extends through packer element 40. A lower packer head 46 has its upper end attached to the lower end of the packer element 40 and its lower end threadedly connected to a packer sub 48. Sub 48 telescopes along extension tube 18 to allow inflation and deflation of the packer element 40. O-ring seals 50 and 52 are provided between head 46 and sub 48 and between sub 48 and extension tube 18, respectively. The packer element 40 is formed of elastomeric material reinforced with expandable cable or the like in a manner wellknown in the art. See, for example, U.S. Pat. No. 3,085,628. The packer element 40 is affixed to heads 42 and 46 in any suitable manner as, for example by means of a potting material held in place by mating irregular formations 41 on the heads 42, 46 and packer element 40.

It can be seen that a first annular space 54 is formed between the control sub 22 and the mandrel 10. Space 54 extends generally from O-ring 26 to the lower end of the sub 22. A second annular space 56 is formed between the mandrel 10 and the packer element 40. Spaces 44 and 46, when not sealed, are in indirect communication with each other via the space 58 bounded by the lower end of the control sub 22, the upper end of the packer element 40, the inner surface of packer head 42, and the outer surface of mandrel 10. A valve mechanism, indicated generally by the numeral 60, is disposed in the first space 54. Control tube 14 has a pair of generally radial ports 52 therethrough near the upper end of valve mechanism 60 in direct communication with the space 54.

The valve mechanism 60 comprises a stack of packing rings 64 encircling the mandrel 10. At the upper end of the stack of packing rings 64 is an annular piston 66, and at the upper end of piston 66 is an annular expanding spring 68. An annular metallic spacer 70 is disposed beneath the rings 64, and a snap ring 72, disposed in an internal annular groove at the bottom of the control sub 22, extends radially inwardly to abut the spacer 70 and limit downward movement of the rings 64. The piston 66 includes longitudinally extending, spaced apart ridges 67 which abut the interior of control sub 22 to maintain proper alignment of the piston while providing space for fluid to flow past the piston.

Control tube 14 has an external annular recess 74 adjacent the ports 62. Recess 74 forms an inclined external annular shoulder 76 on control tube 14 within the space 54 and facing partially axially upwardly and partially radially outwardly. The portion of control tube 14 generally between shoulder 76 and packer tube 16 forms an external upset or large outer diameter section 78 of the mandrel 10. Ridge 30 of control sub 22 forms an inclined internal annular shoulder 80 facing partially axially downwardly and partially radially inwardly. As shown in FIG. 1A, when the mandrel 10 is in its lowermost position with respect to control sub 22, i.e. when the flange 34 is abutting shoulder 32, the shoulders 76 and 80 are generally opposed to each other and the lower portion of upset 78 is aligned with the stack of packing rings 64.

Figure 1B:
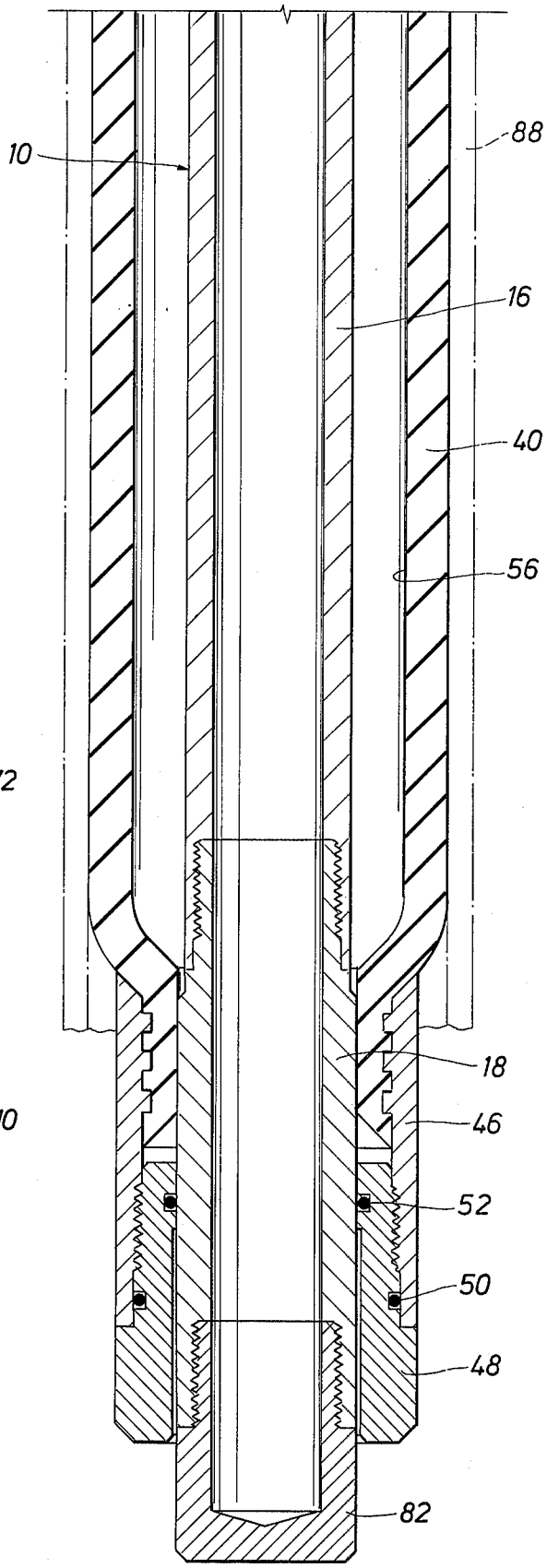
FIG. 1B is a continuation of FIG. 1A showing a longitudinal sectional view through the lower portion of the tool of FIG. 1A after inflation but prior to setting of the packer element.

The outer diameter of upset 78 is slightly greater than the inner diameter of packing rings 64. Rings 64 are of generally V-shaped transverse cross section and are disposed in space 54 with their apices facing upwardly. Thus, with the various parts of the packer in the positions shown in FIG. 1, fluid can flow from ports 62, through spaces 54 and 58, and into space 56 when there is a pressure differential decreasing across rings 64 toward space 56, i.e. downwardly, since such pressure differential will deflect the lips of the V-shaped rings 64 downwardly allowing the fluid to flow past the rings 64. However, the presence of a pressure differential decreasing upwardly, i.e. toward ports 62, across the rings 64 will urge the lips of the rings 64 into tight engagement with the control sub 22 and control tube upset 78 so that a seal is formed between the space 56 and the ports 62.

To inflate and set the packer element 40, the lower end of the mandrel 10 must be closed. This may be accomplished by a bull plug 82 threaded into the lower end of the extension tube 18. Alternatively, as shown in FIG. 6, a ball seat member 84 may be threaded into the lower end of the extension tube 18 and a ball 86 pumped through the mandrel until it seats at the lower end as shown. The latter closure means allows the mandrel to be reopened after setting of the packer by pumping ball 86 out through the lower end of seat member 84.

With the lower end of the mandrel 10 closed, and the tool in the position shown in FIG. 3, clean fluid is pumped through the drill stem or tubing into the mandrel. When the fluid reaches the level of ports 62 it will flow through the ports, through spaces 54 and 58, and into space 56 inflating the packer element 40 and bringing it into firm engagement with the well casing 88. The mandrel 10 can now be moved longitudinally with respect to the control sub 22 since the engagement of packer element 40 with casing 88 holds the attached sub 22 in a fixed position. Mandrel 10 is now lowered to the position shown in FIGS. 1A and 1B.

Figure 2A:
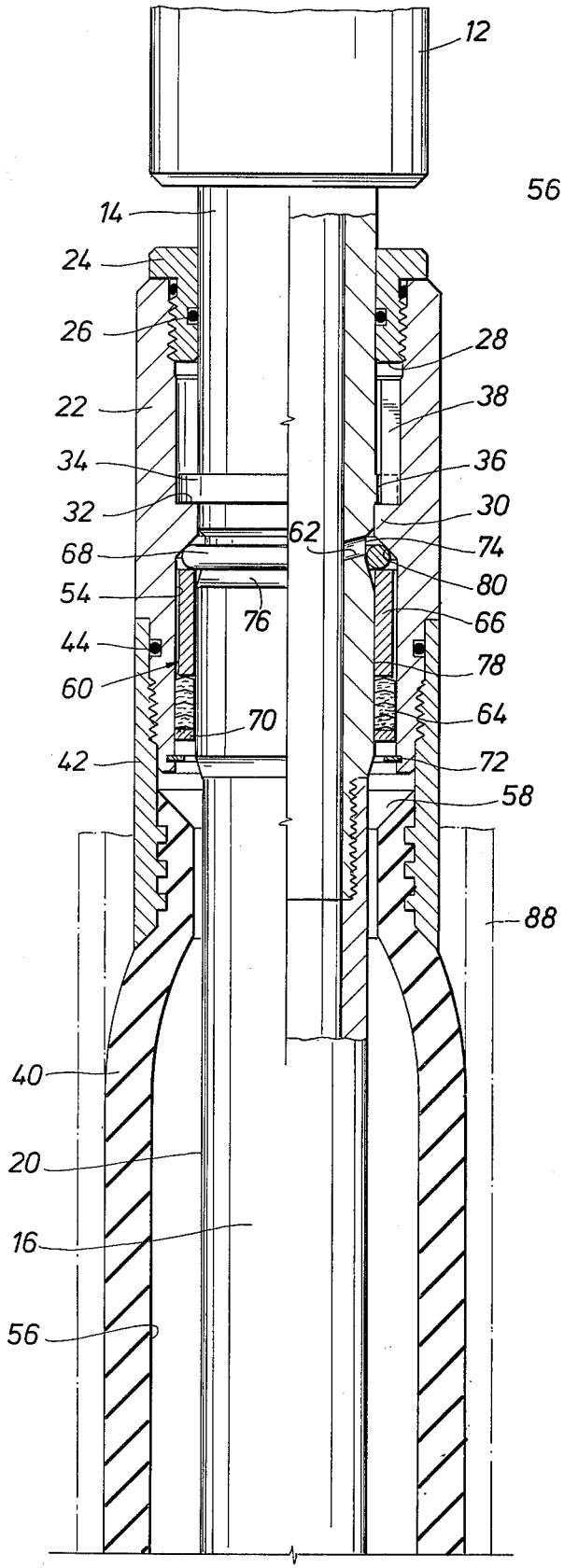
FIG. 2A is a longitudinal sectional view through the upper portion of the tool after inflation and setting of the packer element.
Figure 2B:
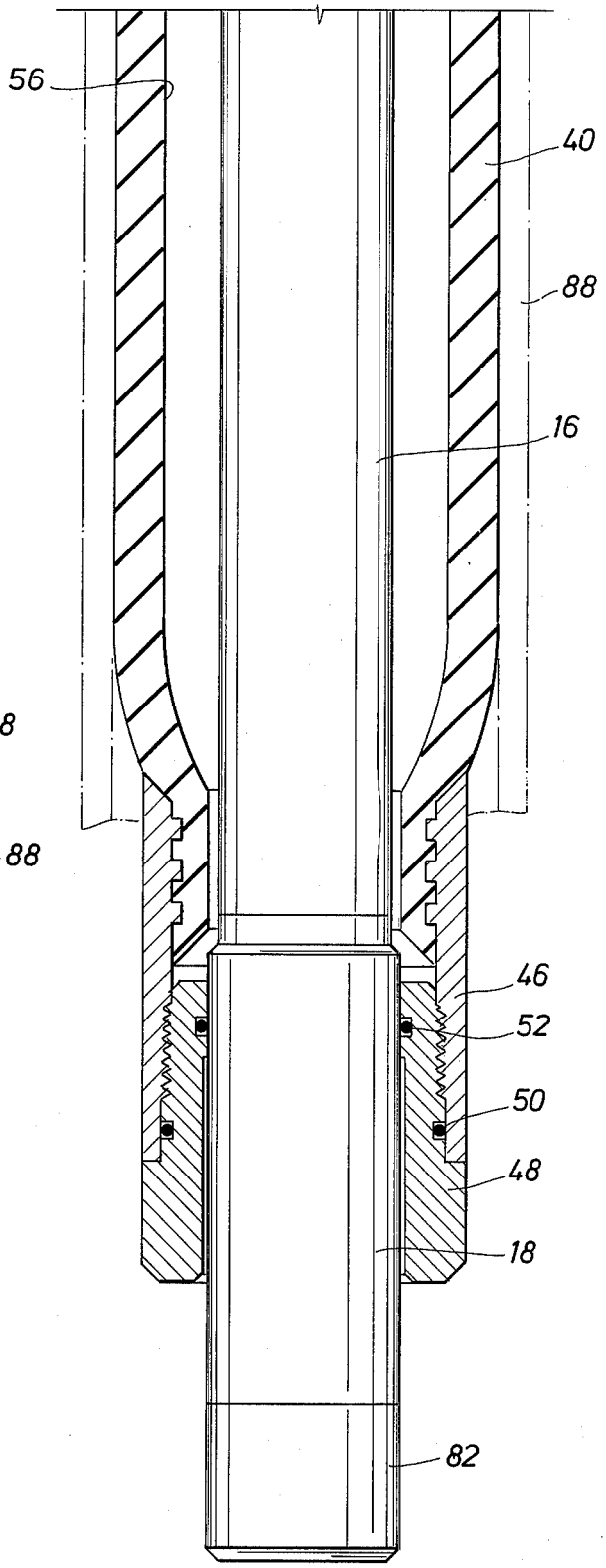
FIG. 2B is continuation of FIG. 2A showing a longitudinal sectional view through the lower portion of the tool after inflation and setting of the packer.

The packer is now set by releasing the pump pressure on the fluid in spaces 54, 58 and 56. The pressure differential across rings 64 is thus reversed as fluid now tends to flow from space 56 toward ports 62 causing rings 64 to seal space 56 from ports 62 as explained above. At the same time, the upwardly decreasing pressure differential moves rings 64, together with piston 66 and spring 68, upwardly in space 54 to the position shown in FIG. 2A. The force on rings 64 is transmitted by piston 66 to spring 68 whereby the latter is wedged between shoulders 76 and 80, as shown in FIG. 2A. It can be seen that if the mandrel 10 where to move upwardly with respect to control sub 22 bringing small diameter section 20 into alignment with rings 64, the seal between space 56 and ports 62 would be broken as the outer diameter of section 20 is less than the inner diameter of rings 64. However the engagement of spring 68 with opposed shoulders 76 and 80 prevents such movement under forces below a predetermined limit.

To deflate the packer element 40, an upward pull is exerted on the mandrel in excess of the aforementioned limit. This forces shoulder 76 past spring 68 allowing the mandrel 10 to move upwardly to the position shown in FIG. 3. Flange 34 is now abutting shoulder 28 and small diameter section 20 of the mandrel 10 has been brought into alignment with the packing rings 64 breaking the seal. Thus the fluid in space 56 flows through spaces 58 and 54 and ports 62 into the mandrel allowing the packer element 40 to deflate.

If there should be insufficient pulling capacity to release the packer in the manner described above, fluid may be pumped into the mandrel reducing or eliminating the upward pressure differential across the packing rings 64. The piston 66 will then be free floating, and not loading the spring 68, so that the mandrel can now be pulled up to the position of FIG. 3 with a relatively small force.

With the parts in the positions shown in FIG. 3, the packer can be reset by again pumping fluid into the mandrel until the packer element is inflated and engages casing 88, moving the mandrel 10 down until stopped by engagement of flange 34 with shoulder 32, and releasing the pump pressure. It can thus be seen that the packer can be reset as many times as desired without ever removing the packer from the well and without the need for rotation of any part from the top of the well.

When releasing the packer, the upward movement of the mandrel 10 will cause the flange 34 to strike shoulder 28 with a substantial force. This provides a jarring action which is often helpful when the packer or an adjacent tool or the like has become struck in the well.

Numerous modifications of the preferred embodiment described above can be made without departing from the spirit of the invention. It is thus intended that the scope of the invention be limited only by the claims which follow.

I claim:

1. An inflatable packer comprising:

a. a first tubular member having generally radial port means therethrough;

b. a second tubular member slidably telescopically mounted on said first tubular member, a first annular space being formed between said tubular members and in communication with said port means;

c. an inflatable packer element carried by said second tubular member, said first tubular member extending through said packer element, a second annular space being formed between said first tubular member and said packer element;

d. a valve means disposed in said first annular space, said valve means comprising i. annular seal means operative upon the presence of a pressure differential decreasing across said seal means toward said second annular space to permit fluid flow through said first annular space from said port means to said second annular space and inflate said packer element, and further operative upon the presence of a pressure differential decreasing across said seal means toward said port means to form a seal between said port means and said second annular space, ii. and locking means operatively associated with said seal means, said locking means being operative upon the presence of said pressure differential decreasing across said seal means toward said port means to lock said first tubular member against movement with respect to said second tubular member in a first longitudinal direction, and releasable upon the application of a force to said first tubular member in said first longitudinal direction to permit relative longitudinal movement of said first tubular member in said first direction to thereby break said seal and deflate said packer element;

e. wherein each of said tubular members has a respective annular shoulder within said first annular space, said shoulders facing at least partially axially and in generally opposite directions, and said tubular members having a first relative position in which said shoulders are generally opposed; wherein said locking means comprises an annular expanding spring disposed axially of said seal means; and wherein said seal means is axially movable toward said spring upon the presence of said pressure differential decreasing across said seal means toward said port means when said tubular members are in said first position to force said spring between said shoulders and into engagement with each of said shoulders.

2. A packer as defined in claim 1 wherein said valve means further comprises rigid force transmitting means interposed between said seal means and said spring.

3. A packer as defined in claim 2 wherein said force transmitting means comprises an annular piston.

4. A packer as defined in claim 1 wherein said first tubular member comprises a large diameter section whose outer diameter is at least as great as the inner diameter of said seal means, and a small diameter section, whose outer diameter is less than the inner diameter of said seal means, said large diameter section being in engagement with said seal means when said tubular members are in said first position; and the application of said force to said first tubular member in said first longitudinal direction being operative to move said first tubular member in said first longitudinal direction to a second position with respect to said second tubular member wherein said shoulders are moved out of opposition to each other, said shoulder of said first tubular member is moved out of engagement with said spring, said large diameter section is moved out of engagement with said seal means, and said small diameter section is moved into alignment with said seal means.

5. A packer as defined in claim 4 further comprising stop means for limiting movement of said first tubular member in said first longitudinal direction to said second position and for limiting movement of said first tubular member in a second longitudinal direction to said first position.

6. A packer as defined in claim 1 wherein said means comprises at least one packing ring.

7. An inflatable packer comprising:

a. a first tubular member having generally radial port means therethrough;

b. a second tubular member slidably telescopically mounted on said first tubular member, a first annular space being formed between said tubular members and in communication with said port means;

c. an inflatable packer element carried by said second tubular member, said first tubular member extending through said packer element, a second annular space being formed betwen said first tubular member and said packer element;

d. a valve means disposed in said first annular space, said valve means comprising i. annular seal means operative upon the presence of a pressure differential decreasing across said seal means toward said second annular space to permit fluid flow through said first annular space from said port means to said second annular space and inflate said packer element, and further operative upon the presence of a pressure differential decreasing across said seal means toward said port means to form a seal between said port means and said second annular space, ii. and locking means operatively associated with said seal means, said locking means being operative upon the presence of said pressure differential decreasing across said seal means toward said port means to lock said first tubular member against movement with respect to said second tubular member in a first longitudinal direction, and releasable upon the application of a force to said first tubular member in said first longitudinal direction to permit relative longitudinal movement of said first tubular member in said first direction to thereby break said seal and deflate said packer element;

e. wherein said valve means is disposed adjacent one end of said packer element, wherein said first tubular member comprises a free end disposed adjacent the other end of said packer element, and further comprising closure means for sealing said free end of said first tubular member.

8. An inflatable packer comprising:

a. a first tubular member having generally radial port means therethrough;

b. a second tubular member slidably telescopically mounted on said first tubular member, a first annular space being formed between said tubular members and in communication with said port means;

c. an inflatable packer element carried by said second tubular member, said first tubular member extending through said packer element, a second annular space being formed between said first tubular member and said packer element;

d. a valve means disposed in said first annular space, said valve means comprising i. annular seal means operative upon the presence of a pressure differential decreasing across said seal means toward said second annular space to permit fluid flow through said first annular space from said port means to said second annular space and inflate said packer element, and further operative upon the presence of a pressure differential decreasing across said seal means toward said port means to form a seal between said port means and said second annular space, ii. and locking means operatively associated with said seal means, said locking means being operative upon the presence of said pressure differential decreasing across said seal means toward said port means to lock said first tubular member against movement with respect to said second tubular member in a first longitudinal direction, and releasable upon the application of a force to said first tubular member in said first longitudinal direction to permit relative longitudinal movement of said first tubular member in said first direction to thereby break said seal and deflate said packer element;

e. wherein said packer element extends axially from said second tubular member, said valve means being axially spaced from said packer element.

9. An inflatable packer comprising:

a. a first tubular member having generally radial port means therethrough;

b. a second tubular member slidably telescopically mounted on said first tubular member, a first annular space being formed between said tubular members and in communication with said port means;

c. an inflatable packer element carried by said second tubular member, said first tubular member extending through said packer element, a second annular space being formed between said first tubular member and said packer element;

d. a valve means disposed in said first annular space, said valve means comprising i. annular seal means operative upon the presence of a pressure differential decreasing across said seal means toward said second annular space to permit fluid flow through said first annular space from said port means to said second annular space and inflate said packer element, and further operative upon the presence of a pressure differential decreasing across said seal means toward said port means to form a seal between said port means and said second annular space, ii. and locking means operatively associated with said seal means, said locking means being operative upon the presence of said pressure differential decreasing across said seal means toward said port means to lock said first tubular member against movement with respect to said second tubular member in a first longitudinal direction, and releasable upon the application of a force to said first tubular member in said first longitudinal direction to permit relative longitudinal movement of said first tubular member in said first direction to thereby break said seal and deflate said packer element;

e. means cooperative between said tubular members for preventing relative rotation of said tubular members.

10. In a device comprising a first hollow member having generally radial port means therethrough, a second hollow member slidably telescopically mounted on said first hollow member, a first annular space being formed between said hollow members and in communication with said port means, and means associated with said second hollow member defining a second space in communication with said first space, a valve means disposed in said first space and comprising:

seal means encircling said first hollow member operative upon the presence of a pressure differential decreasing across said seal means toward said second space to permit fluid flow through said first space from said port means to said second space, and further operative upon the presence of a pressure differential decreasing across said seal means toward said port means to form a seal between said port means and said second space;

and locking means operatively associated with said seal means, said locking means being operative upon the presence of said pressure differential decreasing across said seal means toward said port means to lock one of said tubular members aganst movement with respect to the other of said tubular members in a first longitudinal direction, and releasable upon the application of a force to said one tubular member in said first longitudinal direction to permit relative longitudinal movement of said first tubular member in said first direction to thereby break said seal;

wherein each of said hollow members has a respective shoulder within said first space, said shoulders facing at least partially axially and in generally opposite directions, and said hollow members having a first relative position in which said shoulders are generally opposed; wherein said locking means comprises an expanding spring ring disposed axially of said seal means; and wherein said seal means is axially movable toward said spring upon the presence of said pressure differential decreasing across said seal means toward said port means when said hollow members are in said first position to force said spring between said shoulders and into engagement with each of said shoulders.

11. The device of claim 10 wherein said valve means further comprises rigid force transmitting means interposed between said seal means and said spring.

12. The device of claim 11 wherein said force transmitting means comprises an annular piston.

13. The device of claim 10 wherein said first and second hollow members, in said first position, are in engagement with respective adjacent inner and outer surfaces of said seal means; wherein said one of said hollow members has an offset section, said hollow members having a second relative position in which said offset section is adjacent the respective surface of said seal means but spaced radially therefrom and said shoulders are out of opposition to each other; and wherein the application of said force to said one hollow member in said first longitudinal direction is operative to move said one tubular member in said first longitudinal direction to said second position.

14. The device of claim 10 wherein said seal means comprises at least one packing ring.

* * * * *